US012496687B2

(12) United States Patent
Plichon et al.

(10) Patent No.: US 12,496,687 B2
(45) Date of Patent: Dec. 16, 2025

(54) SHARPENING SHEATH ADAPTED TO RECEIVE A KNIFE, AND COMBINATION OF SUCH A SHEATH AND A KNIFE

(71) Applicant: SEB S.A., Ecully (FR)

(72) Inventors: Stéphane Plichon, Allonzier-la-Caille (FR); Stéphane Suchet, Marcellaz-Albanais (FR)

(73) Assignee: SEB S.A. (FR)

( * ) Notice: Subject to any disclaimer, the term of this patent is extended or adjusted under 35 U.S.C. 154(b) by 408 days.

(21) Appl. No.: 17/918,383

(22) PCT Filed: Mar. 5, 2021

(86) PCT No.: PCT/EP2021/055681
§ 371 (c)(1),
(2) Date: Oct. 12, 2022

(87) PCT Pub. No.: WO2021/209194
PCT Pub. Date: Oct. 21, 2021

(65) Prior Publication Data

US 2023/0140211 A1 May 4, 2023

(30) Foreign Application Priority Data

Apr. 14, 2020 (FR) ..... 2003708

(51) Int. Cl.
*B24D 15/08* (2006.01)

(52) U.S. Cl.
CPC ..... *B24D 15/084* (2013.01); *B24D 15/081* (2013.01)

(58) Field of Classification Search
CPC .... B24D 15/084; B24D 15/081; B24D 15/08; B24D 15/06; B24D 15/065; B24B 3/36; B24B 3/54
(Continued)

(56) References Cited

U.S. PATENT DOCUMENTS 3,676,961 A 7/1972 Jackson
3,774,350 A * 11/1973 Bayly ..... B26B 29/025 451/555
(Continued)

FOREIGN PATENT DOCUMENTS

CA 1046774 A 1/1979
CN 209349969 U 9/2019
(Continued)

OTHER PUBLICATIONS

International Search Report for Application No. PCT/EP2021/055681 mailed May 31, 2021, pp. 1-3.
(Continued)

*Primary Examiner* — Monica S Carter
*Assistant Examiner* — Caleb Andrew Holizna
(74) *Attorney, Agent, or Firm* — Lerner David LLP

(57) ABSTRACT

A sharpening sheath, adapted to receive a knife to be sharpened or stored, comprising a cavity for receiving a blade, an access opening at one end of the cavity, the sheath comprising, preferably in the vicinity of the access opening an upper part provided with a guiding device for the back of the blade and a lower part comprising a sharpening device on which the cutting edge of the blade is intended to be applied when inserting or extracting the blade in the sheath, characterized in that the guide device comprises a V-shaped groove and in that the sharpening device comprises two sharpening elements arranged in a V-shape opposite the groove of the guide device, the sharpening device being mounted so as to be movable relative to the guide device and being returned by return means in the direction of the guide device.

13 Claims, 5 Drawing Sheets

(58) Field of Classification Search
USPC ..... 451/555, 552
See application file for complete search history.

(56) References Cited

U.S. PATENT DOCUMENTS

| | | | | |
|---|---|---|---|---|
| 3,861,246 | A | 1/1975 | Waller | |
| 4,041,651 | A | 8/1977 | Bayly | |
| 4,117,748 | A | 10/1978 | Watts | |
| 4,428,515 | A * | 1/1984 | Mayer | B26B 29/025 224/232 |
| 4,669,337 | A | 6/1987 | Petroff | |
| 4,718,200 | A | 1/1988 | Miquelot | |
| 4,805,350 | A | 2/1989 | Farrer | |
| 5,245,756 | A | 9/1993 | Howell et al. | |
| 5,440,953 | A | 8/1995 | Gangelhoff et al. | |
| 5,784,786 | A * | 7/1998 | Williams | B24D 15/084 30/298.4 |
| 6,117,002 | A | 9/2000 | Stokes et al. | |
| 6,224,475 | B1 | 5/2001 | May et al. | |
| 6,375,016 | B1 * | 4/2002 | Stuchlik, III | A47G 21/14 248/37.3 |
| 6,427,333 | B1 | 8/2002 | Veltz et al. | |
| 2012/0180602 | A1 | 7/2012 | Murphy et al. | |
| 2013/0026054 | A1 | 1/2013 | Adams | |
| 2016/0368116 | A1 | 12/2016 | Wu | |
| 2018/0207827 | A1 | 7/2018 | Hsieh | |
| 2019/0351570 | A1 | 11/2019 | Siffermann | |

FOREIGN PATENT DOCUMENTS

| | | | |
|---|---|---|---|
| CO | 92257179 | | 6/1986 |
| EP | 0665086 | A1 | 8/1995 |
| FR | 2223140 | A1 | 10/1974 |
| FR | 2333614 | A1 | 7/1977 |
| FR | 2576537 | A1 | 8/1986 |
| GB | 1332598 | A | 10/1973 |
| GB | 1532548 | A | 11/1978 |
| JP | S52038695 | A | 3/1977 |
| JP | S52092994 | A | 8/1977 |
| JP | S53015695 | A | 2/1978 |
| JP | S59151985 | A | 8/1984 |
| JP | S62043574 | U | 3/1987 |
| JP | S63076260 | U | 5/1988 |
| JP | 2000167271 | A | 6/2000 |
| JP | 2003524528 | A | 8/2003 |
| RU | 2212 | U1 | 6/1996 |
| SU | 967263 | A3 | 10/1982 |
| TW | 506325 | U | 10/2002 |

OTHER PUBLICATIONS

Search Report dated Dec. 14, 2023 from Office Action for Chinese Application No. 202180028125.3 issued Dec. 15, 2023. 3 pgs.
Colombian Search Report for Application No. NC2022/0013853 dated May 8, 2024, 2 pages. [See p. 1, categorizing the cited references].
Russian Search Report for Application No. 2022125914/05 dated May 15, 2024, 2 pages. [See p. 1-2, categorizing the cited references].

* cited by examiner

[Fig 1]
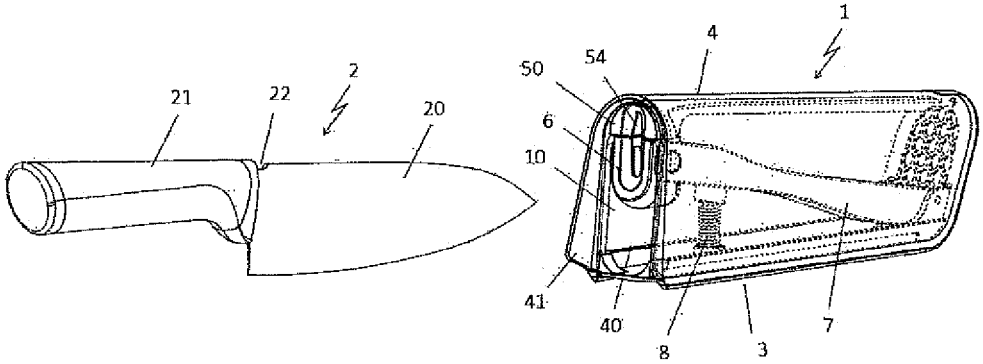
[Fig 2]
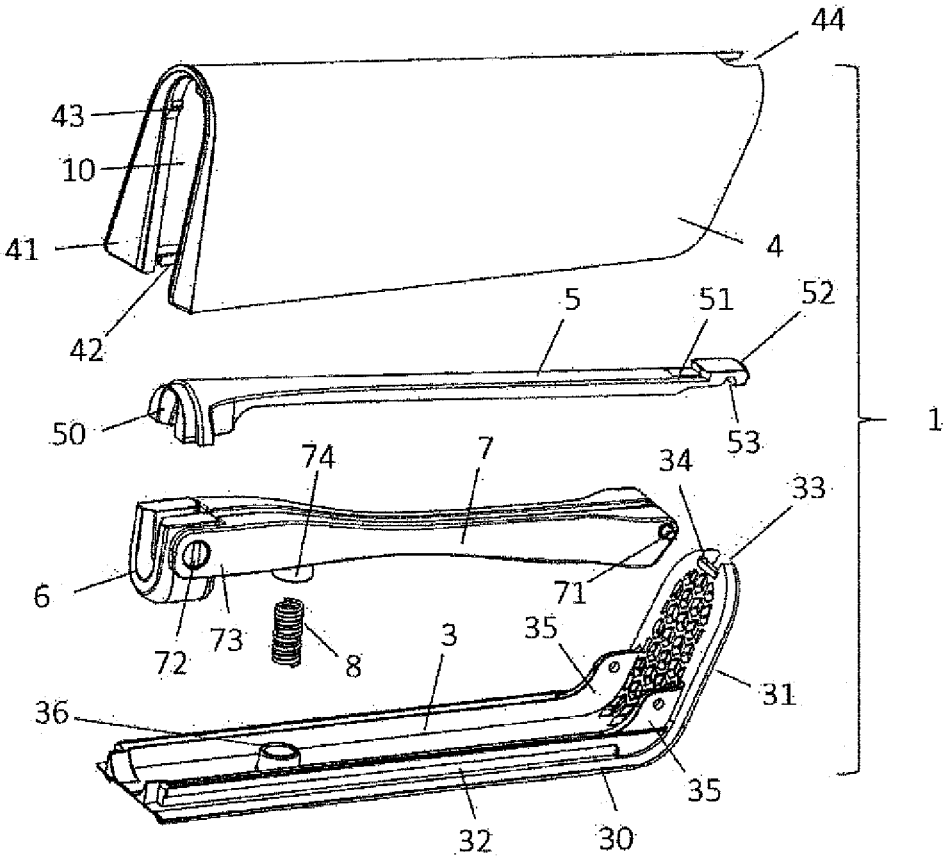

[Fig 3]
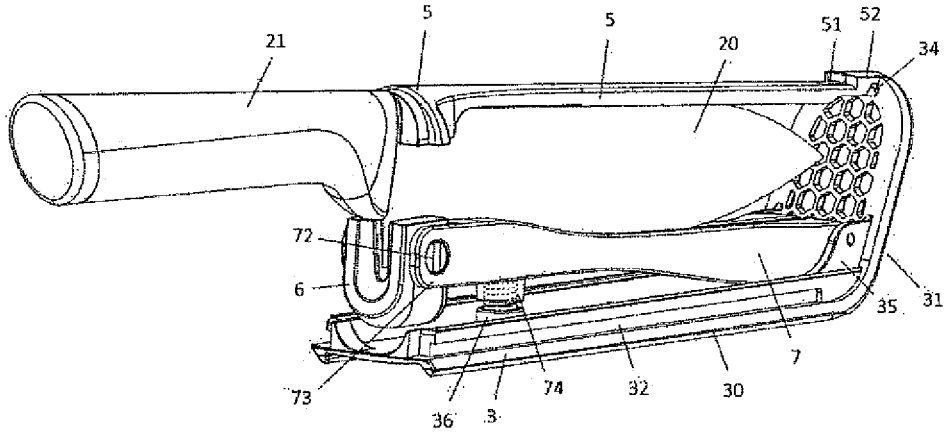
[Fig 4]
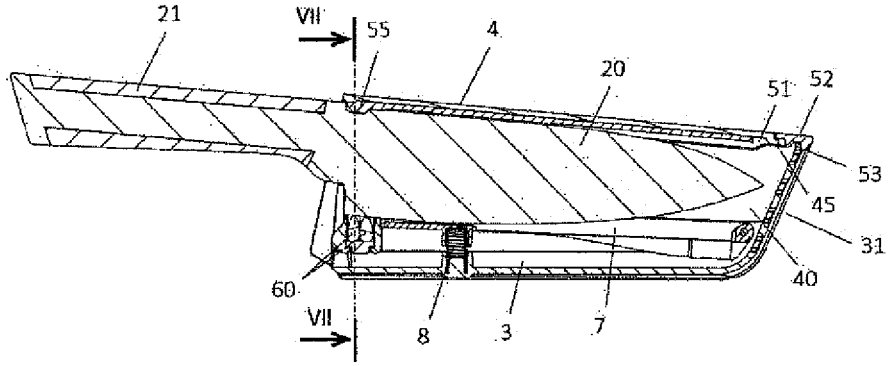
[Fig 5]
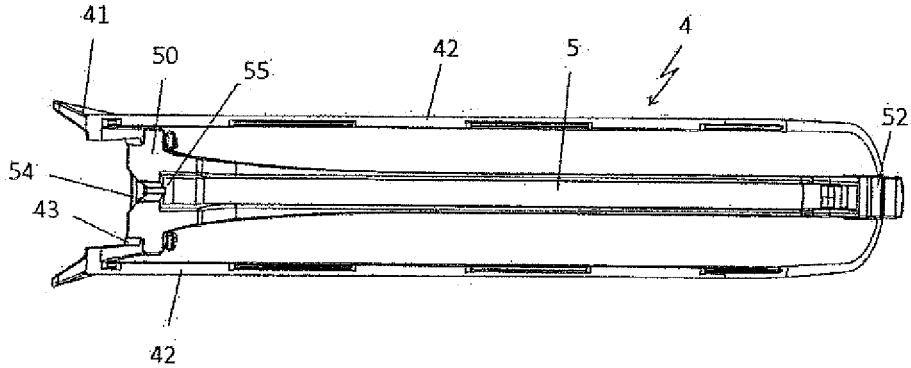

[Fig 6]
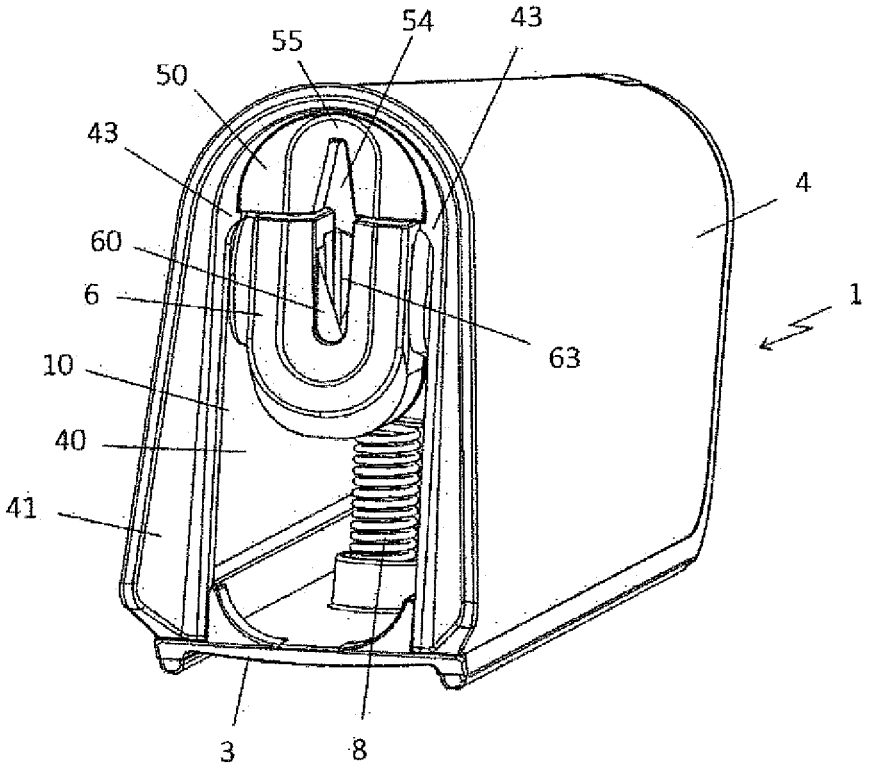

[Fig 7]
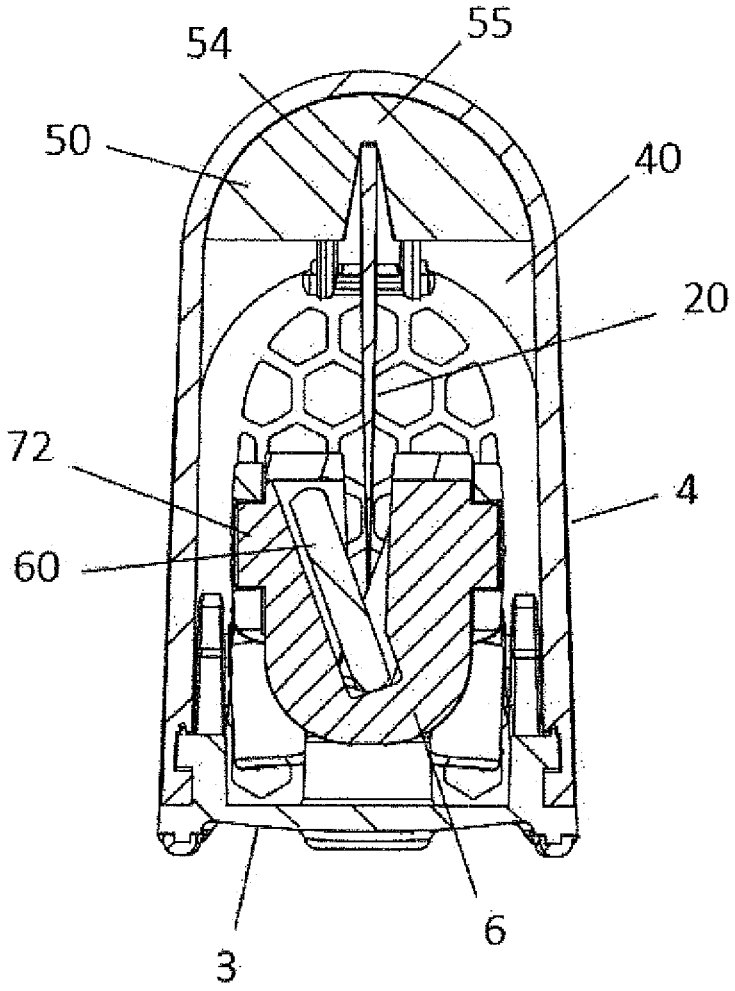

[Fig 8]
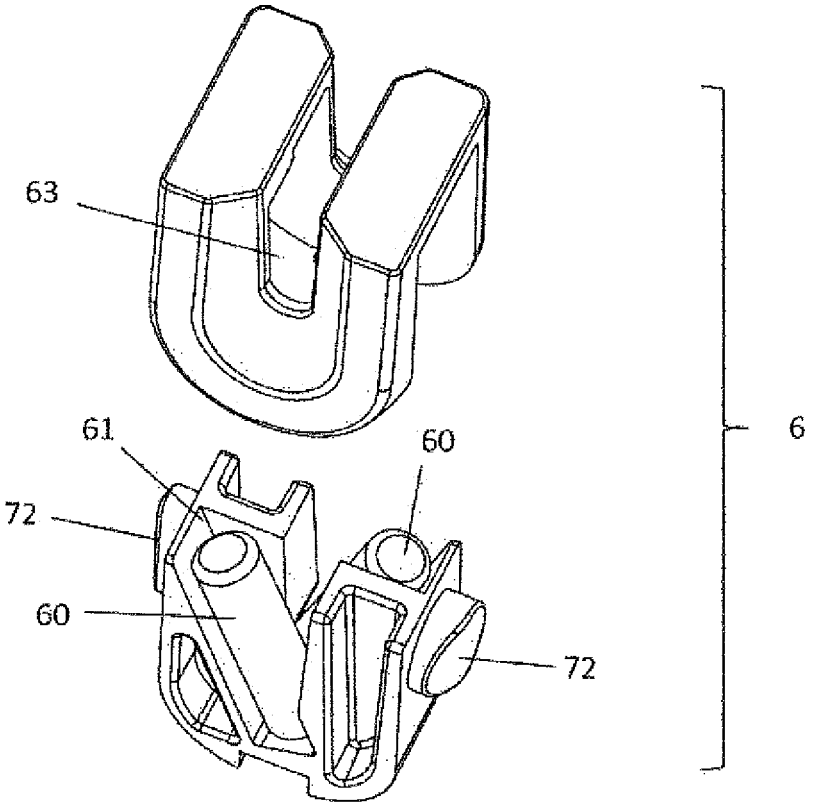

SHARPENING SHEATH ADAPTED TO RECEIVE A KNIFE, AND COMBINATION OF SUCH A SHEATH AND A KNIFE

CROSS-REFERENCE TO RELATED APPLICATIONS

The present application is a national phase entry under 35 U.S.C. § 371 of International Application No. PCT/EP2021/055681 filed Mar. 5, 2021, which claims priority from French Application No. 2003708 filed on Apr. 14, 2020, all of which are incorporated herein by reference.

TECHNICAL FIELD

The present invention relates to the field of blade sharpeners and concerns in particular scissor and kitchen knife blade sheaths incorporating a sharpener.

STATE OF THE ART

It is known different manual systems of sharpening of kitchen knives. The first knife sharpeners were simple stones or guns requiring from the user a certain mastery and dexterity of the gesture allowing the sharpening of the blade, and requiring a knowledge of the sharpening angles.

It is known that there are more complex knife sharpeners that try to simplify and facilitate their use for a neophyte user by allowing a greater precision of sharpening. However, these systems have the disadvantage of sharpening only one side of the blade at a time, or of causing premature wear of the blade.

As an example, it is known from the document FR2576537, a sharpening scabbard associated with a knife which allows to simplify the sharpening operation.

However, such a device has the disadvantage that it causes premature wear of the blade and/or is highly dependent on the blade height, so that such a sheath is not suitable for holding knives with very different blade heights.

SUMMARY OF THE INVENTION

The purpose of the invention is to propose a knife sharpening scabbard with a precise guidance allowing the user to have a maximum guarantee on the quality of his sharpening angles and on the sharpening efficiency. Another aim of the invention is to provide a knife sharpening scabbard which guarantees a good sharpening quality on knives regardless of the blade height of the knives.

To this end, the invention has as its object a sharpening sheath, adapted to receive a knife to be sharpened or stored, comprising a cavity intended to receive a blade, an access opening at one end of the cavity, the sheath comprising, preferably in the vicinity of the access opening an upper part provided with a guiding device for the back of the blade and a lower part comprising a sharpening device on which the cutting edge of the blade is intended to be applied when inserting or extracting the blade in the sheath, characterized in that the guide device comprises a V-shaped groove and in that the sharpening device comprises two sharpening elements arranged in a V-shape opposite the groove of the guide device, the sharpening device being movably mounted with respect to the guide device and being returned by return means towards the guide device.

Thus, the V-shaped sharpening elements and the V-groove in combination form a diamond-shaped opening into which the end of the blade is inserted when the knife is stored in the sheath.

Such a feature ensures both good guide and blade centering on both sharpening elements for very different blade profiles and heights. Advantageously, this facing feature allows the sharpening angle to remain symmetrical and constant throughout the sharpening process, i.e. during the friction of the blade against the sharpening elements.

In particular, such a technical solution makes it possible to obtain a regular and constant sharpening of the blade, thanks to the perfect inclination and centering of the blade on the two sharpening elements and the substantially constant pressure exerted by the two sharpening elements on the cutting edge under the effect of the return means.

The device may further have one or more of the following features, taken alone or in combination.

According to an advantageous feature of the invention, the sharpening device is attached to an arm rotatably mounted inside the sheath.

The advantage of such a construction is that it is simple and economical to make and allows for both a good hold and a large amount of travel of the sharpening device along the cutting edge of the blade.

According to an advantageous feature of the invention, the two sharpening elements are arranged in two offset planes parallel to each other and perpendicular to the longitudinal axis of the sheath.

This arrangement reduces the width of the grinding device.

According to an advantageous feature of the invention, the arm has a first longitudinal end that is pivotally mounted on a base.

According to an advantageous feature of the invention, the return means comprise a return spring, advantageously helical, interposed between the arm and a base.

Such a construction has the advantage of being simple and economical to realize.

According to an advantageous feature of the invention, the sharpening elements are arranged in a sharpening device which is pivotally mounted at a second longitudinal end of the arm.

Such a feature optimizes blade sharpening when the blade has a pronounced curvature, by allowing the sharpening device to pivot to follow a curved profile of the blade.

According to an advantageous feature of the invention, the arm is pivotally mounted on the quill about a first pivot axis and the sharpening device is pivotally mounted on the arm about a second pivot axis, the first and second pivot axes being parallel.

According to an advantageous feature of the invention, the sharpening device is disposed adjacent to the access opening.

Such a feature allows the blade to be sharpened along substantially the entire length that is inserted into the sheath.

According to an advantageous feature of the invention, the sheath comprises a base and a casing removably mounted on the base.

This feature simplifies the cleaning of the interior of the sheath.

The invention also relates to a combination of a sharpening sheath as previously described and a knife to be sharpened or stored in said sheath.

According to an advantageous feature of the invention, the sheath comprises a locking element cooperating with a safety notch provided on the back of the blade to longitudinally immobilize the knife in the sheath when the knife occupies a storage position in which the blade is inserted into the sheath.

BRIEF DESCRIPTION OF THE FIGURES

The purposes, aspects and advantages of this invention, according to the description given below of a particular embodiment of the invention presented by way of non-limiting example, will be better understood by referring to the attached drawings in which:

FIG. 1 is a perspective view of a sheath and a knife according to a particular embodiment of the invention; the knife being represented on the outside of the sheath.

FIG. 2 is an exploded perspective view of the sheath of FIG. 1;

FIG. 3 is a perspective view of the sheath of FIG. 1 with the knife introduced into the sheath, the sheath being in this figure shown without its outer shell in order to allow visual access to the sheath mechanism;

FIG. 4 is a longitudinal sectional view of the sheath and knife in the position shown in FIG. 3;

FIG. 5 is a bottom view of the removable sheath shell;

FIG. 6 is another perspective view of the sheath of FIG. 1 lacking its knife;

FIG. 7 is a cross-sectional view according to line VII-VII of FIG. 4;

FIG. 8 is an exploded perspective view of the sharpening device in the sheath.

Only those elements required in order to understand the invention have been depicted. In order to facilitate interpretation of the drawings, the same elements are labeled with the same references across all the figures.

Note that in this document, the terms "horizontal", "vertical", "lower", "upper", "top", "bottom", "front", "back", "longitudinal", "transverse", used to describe the sharpener refer to the sharpener in use, when it is lying flat on its base.

FIGS. 1, 3 and 4 show a sharpening sheath 1 and a kitchen knife 2 comprising a blade 20 intended to be stored in the sheath 1, the knife 2 classically comprising a handle 21 which protrudes out of the sheath 1 when the blade 20 is stored in the sheath 1.

According to FIG. 2, the sheath 1 comprises a base 3 and a casing 4 fixed on each other, and advantageously made of plastic material. The base 3 and the casing 4 have an elongated shape defining a cavity 40 intended to receive the blade 20 of the knife 2 for storage, the sheath 1 having a rear end provided with an access opening 10 through which the blade 20 of the knife 2 can be introduced into the cavity 40. Upstream of the access opening 10, the casing 4 has a guide skirt 41 which has walls that converge in the direction of the access opening 10 and allow the tip of the blade 20 of the knife 1 to be guided towards the access opening 10.

The base 3 comprises a base 30 comprising a lower face intended to rest flat on a support and comprises a front end formed by a grid 31 which extends upwards from the base 30 forming an angle of the order of 65° with respect to the lower face of the base 30, the grid 31 closing the front end of the sheath 1 and advantageously being obtained by molding with the base 30.

The opening 4 is advantageously removably fixed to the base 3 and has an inverted U-shaped cross-section, visible in FIG. 5, comprising, at each of its ends, a rib 42 engaging in a guide groove 32 provided longitudinally on each side of the base 30 of the base 3.

In accordance with FIGS. 3 and 4, the sheath 1 has a device for guiding the upper part of the blade 20 of the knife 2, also referred to as the back of the blade 20, comprising a guide piece 5 fixed inside the sheath 4, at its curved part defining the top of the sheath 4, the guide piece 5 extending in the longitudinal axis of the sheath 1 from the open end of the sheath 1 to the grid 31 defining the front end of the sheath 1.

Preferably, the guide piece 5 comprises an opening 51 in the vicinity of its front end, in which a hook 45 carried by the opening 4, visible in FIGS. 2 and 4, engages, the front end of the guide piece 5 comprising a head 52 which projects upwards and which engages in a suitable cut-out 44 provided at the front end of the opening 4.

The insertion of the hook 45 into the opening 51 and the engagement of the head 52 in the indentation 44 allow the front end of the guide piece 5 to be removably fixed to the front end of the opening 4.

The guide piece 5 is advantageously fixed to the rear end of the opening 4 by clipping, the rear end of the guide piece 5 comprising a centering ring 50 that resiliently engages between two locking clips 43 projecting from the edges of the access opening 10 of the sheath 1.

As can be seen in FIG. 2, the head 52 of the guide piece 5 engages longitudinally in a notch 33 provided at the upper end of the grid 31 when the envelope 4 is put in place on the base 3, the head 52 having a lower face comprising a groove 53 in which a locking tab 34 disposed at the base of the notch 33 resiliently engages, making it possible to maintain the envelope 4 in position on the base 3.

In accordance with FIGS. 5 and 6, the centering ring 50 has an inverted V-shaped groove 54 providing centering of the back in the blade 20 relative to the sheath 4 when the blade 20 is inserted into the sheath 1.

The sheath 1 comprises, opposite the centering ring 50, a sharpening device 6 advantageously carried by an arm 7 pivotally mounted on the base 3, the sharpening device 6 being returned in the direction of the centering ring 50 by a return spring 8 acting on the arm 7. Preferably, the arm 7 is movable in the plane of the blade 20 between a high position where the return spring 8 is extended to its maximum and a low position where the return spring 8 is compressed to its maximum.

According to FIGS. 2 and 3, the arm 7 has a first end, called the front end, pivotally mounted in the vicinity of the front end of the base 3, by means of a first axis 71 extending perpendicular to the longitudinal direction of the base 3. In the particular embodiment shown in the figures, the first axis 71 is supported by two lateral partitions 35 extending vertically on either side of the front end of the arm 7, these lateral partitions 35 contributing to the rigidity of the connection between the base 30 and the grid 31.

The arm 7 has a second end, the so-called rear end, on which the grinding/sharpening device 6 is preferably pivotally mounted about a second axis 72 extending parallel to the first axis 71, the device being able to pivot relative to the arm 7 over an angular range of at least 15° and preferably about 30°.

In the example shown in the figures, the arm 7 comprises two lateral lugs 73 which project towards the rear of the arm 7 and between which the sharpening device 6 is arranged, the second axis 72 being advantageously formed by cylindrical pins of circular cross-section which project laterally from the sharpening device 6 and which are engaged in circular openings provided in the lateral lugs 73.

As can be seen more precisely in FIG. 8, the sharpening device 6 comprises a U-shaped body supporting two sharpening elements 60 arranged so as to form a V in a plane of projection perpendicular to the longitudinal axis of the sheath 1, i.e. when the sharpening device 6 is seen along the direction of introduction of the blade 20 into the access opening 10 of the sheath 1, the two sharpening elements 60 being staggered on the longitudinal axis of the sheath 1 and each extending in a plane perpendicular to the longitudinal axis.

The two grinding/sharpening elements 60, advantageously constituted by two cylinders of ceramic material, are disposed in two housings 61 arranged to hold two grinding/sharpening elements 60 in the V-shaped arrangement, the grinding/sharpening device 6 comprising a slot 63, arranged between the two U-shaped legs, providing access to the space between the two grinding/sharpening elements 60. The two sharpening elements 60 are immobilized by friction inside their housing 61 thanks to the support of a part of the body of the sharpening device 6, not visible on the figures, against the end of the sharpening element 60. Thus, the sharpening elements 60 do not rotate in their housing 61, or only slightly, when they are subjected to the friction of the blade 20 during the insertion or extraction of the latter in the sheath 1.

In the particular embodiment shown in the figures, the return spring 8 is a coil spring arranged between the base 3 and the underside of the arm 7, near the rear end of the arm 7. In order to ensure that the return spring 8 is held between the arm 7 and the base 3, the base 3 comprises a cup 36 for holding the lower end of the return spring 8 and the lower face of the arm 7 comprises a cup 74 for holding the upper end of the return spring 8, the cup 74 facing the cup 36 when the arm 7 is brought towards the base 3.

Advantageously, the back of the blade 20 of the knife 2 has a safety notch 22, preferably arranged in the vicinity of the handle 21 of the knife 2, in which a locking element 55, constituted by the bottom of the groove 54, engages when the entire blade 20 is inserted through the sheath 1, as illustrated in FIGS. 3 and 4. Such insertion of the locking element 55 into the safety notch 22, under the effect of the thrust of the return spring 8 on the arm 7, allows the knife 2 to be immobilized longitudinally in the sheath 1 in a storage position.

The operation of the Sharpener Liner 1 will now be described.

When the user wants to put the blade 20 of the knife 2 back into the sheath 1 or to sharpen it, he brings the tip of the knife 2 in front of the diamond-shaped opening, visible in FIG. 6, formed by the groove 54 and by the two sharpening elements 60, and then introduces the blade 20 of the knife 2 into the sheath 1 by a longitudinal movement. During this movement, the back of the blade 20 is centered in the bottom of the V-shaped groove 54 while the cutting part of the blade 20 is centered by the V formed by the two sharpening elements 60.

This double positioning of the cutting part of the blade 20 and the back of the blade 20 makes it possible to obtain a sharpening angle that remains symmetrical and constant throughout the path of the blade 20 in the sheath 1, without the user having to manually orient the blade 20. Thus, the symmetry of the sharpening is guaranteed and the sharpening angles are equal on each side of the blade wire, which allows a homogeneous and centered wear of the blade 20.

Moreover, during this introduction or during the extraction of the blade 20 from the sheath 1, the pivoting movement of the arm 7 allows the sharpening device 6 to follow the profile of the cutting part of the blade 20, the sharpening device 6 exerting, under the effect of the return spring 8, a moderate pressure on the cutting part of the blade 20 when the tip of the blade is introduced into the access opening 10 of the sheath 1, and then an increasing pressure as the height of the blade 20 increases when the knife 2 is introduced into the sheath 1. The high friction between the cutting portion of the blade 20 and the sharpening elements 60 causes the blade 20 to sharpen.

Finally, since the sharpening elements are placed one behind the other, in the direction of insertion of the blade 20, the possible oscillation of the sharpening device 6 with respect to the second end of the arm 7 allows the sharpening elements 60 to remain in permanent contact with the blade 20 and to remain correctly oriented with respect to the latter, thus optimizing the sharpening of the blade 20.

When the blade 20 of the knife 2 is fully inserted into the sheath 1, the locking element 55 of the centering ring 50 is inserted into the safety notch 22 on the back of the blade 20 under the effect of the return spring 8. The knife 2 is then held securely in the sheath 1. To remove the knife 2 from the sheath 1, the user must first exert downward pressure on the handle 21 of the knife 2 to pull the locking element 55 out of the safety notch 22, and then pull the handle 21 of the knife 2 to remove the blade 20. Such handling avoids any accidental dropping of the knife 2 that might occur, for example, when the sheath 1 is handled for transport.

Furthermore, the sheath 1 thus made also has the advantage of allowing easy cleaning of the interior of the sheath 1. Indeed, the user can easily uncouple the envelope 4 from the base 3 by holding the base 3 with one hand, after having removed the knife 2, then by exerting a traction on the envelope 4 so that the groove 53 disengages, by elastic deformation of the head 52, from the locking tab 34 arranged at the top of the grid 31. The opening 4 can then be slid onto the base 3, each guide groove 32 of the base 3 having, on the side of the access opening 10, an open longitudinal end allowing the extraction of the rib 42 of the envelope 4. After cleaning the inside of the sheath 1, the envelope 4 can be reassembled on the base 3 by carrying out the operations described above in reverse order.

Of course, the invention is in no way limited to the embodiment described and illustrated, since this embodiment was only provided by way of example. Changes can still be made, particularly with regard to the constitution of the various elements or by substituting technical equivalents, without departing from the scope of protection of the invention.

Thus, in an alternative embodiment not shown, the casing may not be removable from the base, the base and the sheath casing may for example be made in one piece.

The invention claimed is:

1. A sheath, adapted to receive a knife to be sharpened or stored, comprising:

a cavity for receiving a blade;

an access opening at one end of the cavity;

the sheath comprising in the vicinity of the access opening an upper part having a guiding device and a lower part configured to be applied to a cutting edge of the blade when inserted into or extracted from the sheath, wherein the guiding device comprises a V-shaped groove configured to receive a back of the blade; and wherein the lower part comprises two elongate elements arranged in a V-shape opposite the V-shaped groove of the guiding device and configured to sharpen the cutting edge of the blade, the two elongate elements and the V-shaped groove together delimit a diamond-shaped opening configured to receive an end of the blade when the knife is inserted and stored in the sheath, the lower part being mounted so as to be movable with respect to the guiding device, the lower part being biased towards the guiding device.

2. The sheath according to claim 1, wherein the lower part is attached to an arm mounted movable in rotation within the sheath.

3. The sheath according to claim 2, wherein the arm comprises a first longitudinal end pivotably mounted on a base.

4. The sheath according to claim 3, further comprising a return means having a return spring interposed between the arm and the base.

5. The sheath according to claim 4, wherein the lower part is pivotably mounted at a second longitudinal end of the arm.

6. The sheath according to claim 3, wherein the lower part is disposed between the guiding device and the base.

7. The sheath according to claim 1, wherein the two elongate elements are arranged in two planes offset parallel to each other and perpendicular to a longitudinal axis of the sheath.

8. The sheath according to claim 1, wherein the lower part is arranged adjacent the access opening.

9. The sheath according to claim 1, further comprising a base and an envelope removably mounted on the base.

10. A combination of the sheath according to claim 1 and a knife for sharpening or storing in the sheath.

11. The combination according to claim 10, wherein the sheath further comprises a locking element cooperating with a safety notch provided on a back of a blade of the knife to immobilize the knife longitudinally in the sheath when the knife occupies a storage position in which the blade is introduced into the sheath.

12. The sheath according to claim 1, wherein the V-shaped groove is configured to contact the back of the blade when the blade is inserted into or extracted from the sheath.

13. A sheath, adapted to receive a knife to be sharpened or stored, comprising:

a cavity for receiving a blade;

an access opening at one end of the cavity;

the sheath comprising in the vicinity of the access opening an upper part having a guiding device and a lower part configured to be applied to a cutting edge of the blade when the blade is inserted into or extracted from the sheath, wherein the guiding device comprises a V-shaped groove configured to receive a back of the blade; and wherein the lower part comprises two cylinders arranged in a V-shape opposite the V-shaped groove of the guiding device and configured to sharpen the cutting edge of the blade, the two cylinders and the V-shaped groove together delimit a diamond-shaped opening configured to receive an end of the blade when the knife is inserted and stored in the sheath, the lower part being mounted so as to be movable with respect to the guiding device, the lower part being biased towards the guiding device.

* * * * *